United States Patent [19]

Etter et al.

[11] Patent Number: 4,793,228

[45] Date of Patent: Dec. 27, 1988

[54] SLICING MACHINE

[75] Inventors: Herbert Etter, Rosenfeld; Klaus Haid, Balingen; Jürgen Schwellbach, Bisingen-Thanheim; Rolf Veit, Balingen, all of Fed. Rep. of Germany

[73] Assignee: Bizerba-Werke Wilhelm Kraut GmbH & Co. KG, Fed. Rep. of Germany

[21] Appl. No.: 57,568

[22] Filed: Jun. 1, 1987

[30] Foreign Application Priority Data

Jun. 4, 1986 [DE] Fed. Rep. of Germany ..... 3618774

[51] Int. Cl.[4] ..... B26D 7/32

[52] U.S. Cl. ..... 83/155.1; 83/23; 83/88

[58] Field of Search ..... 83/23, 88, 69, 155.1, 83/87, 80, 155

[56] References Cited

U.S. PATENT DOCUMENTS 3,834,259 9/1974 Kuchler ..... 83/88 X 4,379,416 4/1983 Kuchler ..... 83/88 X

*Primary Examiner*—Donald R. Schran

*Attorney, Agent, or Firm*—Kramer, Brufsky & Cifelli

[57] ABSTRACT

In a machine for slicing food such as meat, sausage, cheese or the like comprising a conveying device for carrying the slices of food cut off by a rotating blade to a deposit area and a knocking-off mechanism for transferring the slices from the conveying device to the deposit area, the conveying device is driven by an independent motor of its own. The position of a slide carrying the food to be cut can be sensed by sensing means, and a follow-up control device which is connected, on the one hand, to the sensing means, and, on the other hand, to a drive motor and its encoder ensures synchronous follow-up of the conveying device in dependence upon the position of the slide.

13 Claims, 2 Drawing Sheets

SLICING MACHINE

The invention relates to a slicing machine for slicing food such as meat, sausage, cheese or the like comprising a machine frame, a blade mounted on the machine frame and driven by a motor, a slide slidingly displaceable on the machine frame for accommodating and feeding the food to be cut to the blade, a conveying device for carrying the slices cut by the blade to a deposit area and a knocking-off mechanism for transferring the slices from the conveying device to the deposit area.

In known devices of this kind (German Pat. No. 2,303,454), the conveying device for carrying away the cut slices is mechanically connected to the slide by gears and free-wheel mechanisms and is driven via the back and forth motion of the slide. This has various disadvantages: due to the connection of gears and free-wheel mechanisms between conveying device and slide, which may also involve couplings, brakes, trip cams and the like, the entire arrangement of slide and conveying device becomes relatively sluggish and manual actuation of the slide requires considerable effort on the part of the machine operator. Also, the connecting elements between slide and conveying device, including the brakes, trip cams, couplings and the like operate in quite a noisy manner. Finally, inaccuracies may occur in the depositing of the slices as a result of slip tolerances and unavoidable tolerances in the transfer members. Above all, however, the numerous machine elements between slide and conveying device involve considerable manufacturing expenditure and render the arrangement susceptible to breakdown.

The object underlying the invention is to so improve a generic slicing machine that it runs more smoothly and is, therefore, easier to operate, that it is less noisy, that it deposits the slices more accurately and that it is simpler in design and less susceptible to breakdown.

The object is attained, in accordance with the invention, in that the conveying device is driven by an independent motor of its own, in that sensing means are provided for sensing the position of the slide, and in that a follow-up control device is connected, on the one hand, to the sensing means and, on the other hand, to the motor and its encoder, thereby to enable synchronous follow-up of the conveying device in dependence upon the position of the slide.

The following description of preferred embodiments serves in conjunction with the appended drawings to explain the invention in further detail. In the drawings.

Figure 1:
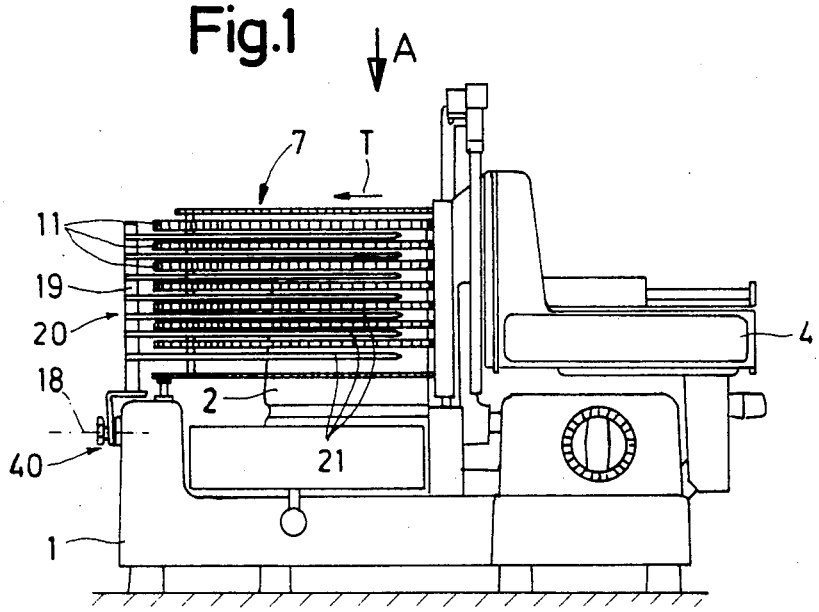
FIG. 1 is a front view of a slicing machine.

The machine for slicing food, in particular, meat, sausage, cheese and the like, illustrated in the appended drawings, comprises, in the conventional manner, a machine frame 1 with a circular blade 3 rotationally driven by a motor 2 mounted thereon. Instead of the circular blade 3 rotating about a pivot arranged stationarily in the housing, oscillating cutters, band knives or the like may be provided. Arranged for sliding displacement on machine frame 1 is a slide 4 serving to accommodate the food 5 to be cut, for example, a sausage (FIG. 2) and to feed the food to be cut to the blade 3.

The slide 4 is displaceable back and forth in the direction of the double arrow S on sliding guides 6.

Figure 2:
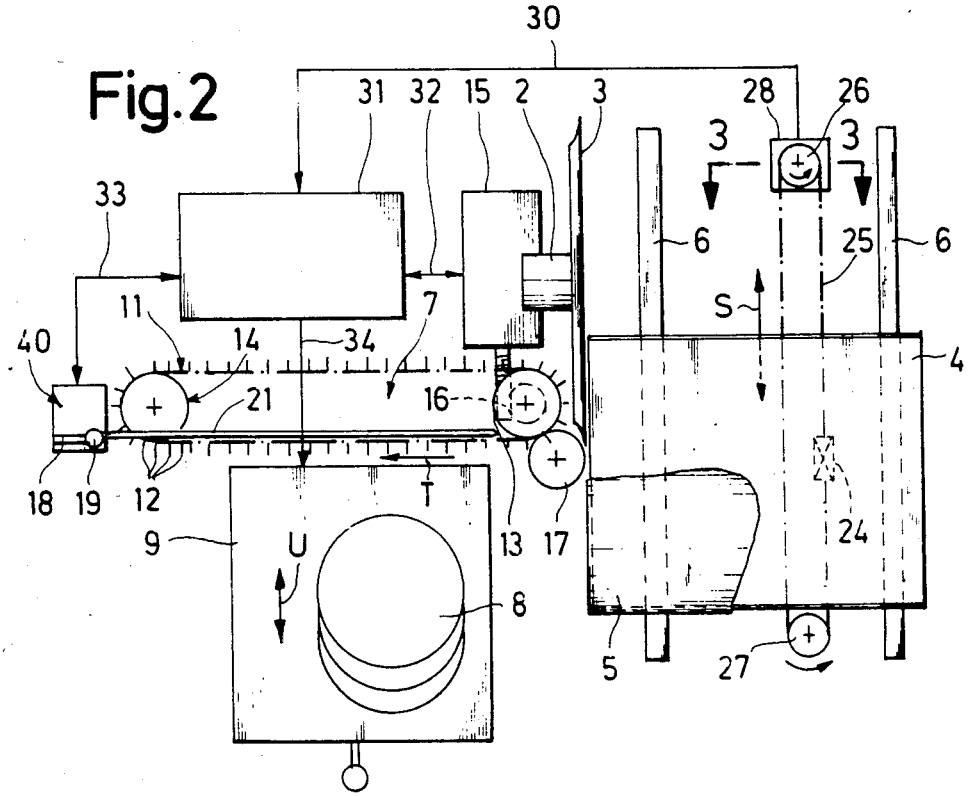
FIG. 2 is a schematic plan view of the machine in the direction of arrow A in FIG. 1.
Figure 3:
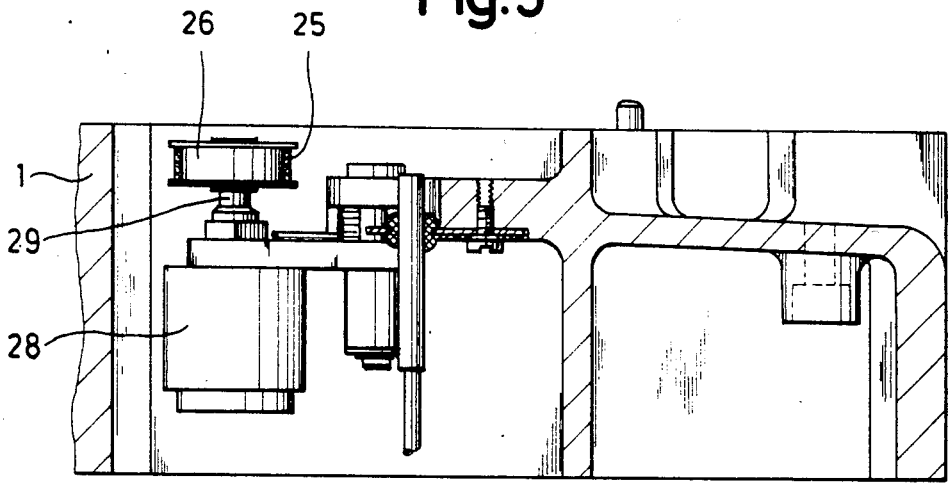
FIG. 3 is a sectional view of individual parts taken on line 3—3 in FIG. 2.

Arranged on machine frame 1, on the side of blade 3 located opposite slide 4 is a conveying device 7 for carrying the slices 8 cut by the blade to a deposit area 9. In FIG. 2, the conveying direction is designated by arrow T. The conveying device comprises in a manner known per se several vertically superimposed chain belts 11 from which tips 12 protrude to accommodate the slices 8. The chain belts 11 extend over a drive roll 13 and tensioning wheels 14. The drive roll 13 is in drive connection with a drive motor 15, for example, via a worm gear 16. A feed roll 17 directs the slices 8 cut off the food 5 by the blade 3 onto the tips 12 of the chain belts 11.

Arranged on machine frame 1 for pivotal motion about a shaft 18 is a knocking-off mechanism 20 comprising in a known manner a normally upright support 19 pivotable about shaft 18, with horizontal bars 21 protruding therefrom between the single chain belts 11 so that the bars lie behind the tips 12 when the knocking-off mechanism is in the rest position. Finally, there is associated with the knocking-off mechanism 20 a drive 40 in the form of a commercially available push-pull magnet or rotary magnet which triggers the downwardly oriented pivotal motion of the knocking-off mechanism 20, thereby to knock off the slices 8 carried along on the tips 12 of the conveying device 7 and to transfer them onto the deposit area 9. In the illustrated embodiment, the deposit area is in the form of a table which is displaceable back and forth in the direction of the double arrow U so that successively deposited slices 8 can be arranged in scale-like superimposed relation, as illustrated in FIG. 2.

A major component of the conveying device 7 is its motor 15 which replaces the hitherto conventional mechanical drive connection with the slide 4. The following arrangement is provided in order to drive the motor 15 of the conveying device 7 synchronously with the slide 4, which is advantageous for proper transfer of the cut slices onto the conveying device 7:

The slide is connected by means of a driver 24 to a drive belt 25 which extends over two deflection rolls 26, 27. Thus, the deflection rolls 26, 27 are made to rotate by the back and forth motion of the slide. A rotary encoder 28, known per se, is in drive connection with deflection roll 26 by, for example, direct positioning of rotary encoder 28 on a shaft 29 of deflection roll 26. On account of its gear connection with slide 4, rotary encoder 28 can, therefore, sense its position. The position signals generated by rotary encoder 28 are fed via a control line 30 to a follow-up control device 31 where they are evaluated. On the other hand, the control device 31 is connected via a further control line 32 to motor 15 and its encoder so that switching-on, synchronous follow-up and switching-off of the conveying device in dependence upon the position of slide 4 are enabled by the position signals originating from the rotary encoder 28. In this way, the cut slices 8 can be taken over by conveying device 7, carried away and deposited over deposit area 9 in an orderly manner. The control device 31 is connected via a further control line 33 to the drive 40 of knocking-off mechanism 20 for the depositing procedure. If the slices 8 are to be deposited in a scale-like manner, the deposit area can be correspondingly displaced in the direction of arrow U via a further control line 34 leading from control device 31 to the drive, not illustrated, of deposit area 9.

A gear connection with the food accommodating slide 4 can thus be eliminated by providing the conveying device 7 with an independent motor 15 of its own. In this way, sluggish gear elements and the like can also be dispensed with so that an operator can move the slide 4 more easily and with much less effort. Also, the arrangement operates in a practically noiseless manner and enables accurate depositing of the slices. Breakdowns are unlikely in view of the simple construction. Maintenance and cleaning are also easy and convenient.

In the embodiment shown, the follow-up control device 31 operates electrically. In other embodiments, the described follow-up control may also be carried out pneumatically or hydraulically.

In the illustrated embodiment, the rotary encoder 28 coupled with slide 4 may also be replaced by a different means for sensing the slide motion, for example, by an angle encoder or a tachogenerator, which may likewise be arranged on shaft 29 of deflection roll 26. Furthermore, the position of slide 4 may be sensed in a likewise known manner by ultrasonic sensors, magnetic strips, graduated glass strips, resistance tracks or photoelectronic measurement devices along the slide guides 6, in which case, corresponding signals are fed to the follow-up control device 31.

In the embodiment shown, the motor 15 drives the conveying device 7 via a worm gear 16. In other embodiments, motor 15 may also be directly arranged on a drive shaft of the conveying device 7, for example, on the shaft of drive roll 13, and motor 15 may also lie within roll 16. A (toothed) belt drive may also be provided between motor 15 and drive roll 16.

It is particularly expedient for motor 15 of conveying device 7 to act as brake for the conveying device after the motor has been switched off, so that the conveying device switches off instantaneously once the conveyed slice reaches the position in which it is transferred onto the deposit area 9 by the knocking-off mechanism 20. The braking effect may be achieved, in a manner known per se, by reversing the polarity of the direction of rotation of the motor. The stopping of motor 15 can be reported back in the usual manner to control device 31 which then triggers the knocking-off mechanism 20.

In another embodiment, asynchronous drive of the conveying device in relation to the stroke of the slide is enabled by a conventional control member provided in the follow-up control device 31 so that sensitive food can be carefully transferred onto the tips 12 of the chain belts 11.

From a presettable position of the food accommodating slide 4 onwards, the conveying device 7 can perform an additional conveying step, i.e. cover an additional conveying distance so that the cut slice can be conveyed out of the transfer area of parts 3, 13 and 14 and brought into the depositing position independently of the motion of the slide. The length of the conveying distance covered in the additional conveying step can be preset by conventional time switches, counting pulse generators, travel measurement devices or the like. The presettable position from which the additional conveying step is introduced can be detected by non-contacting switches or switches with contacts disposed thereon which are allocated to certain positions of the slide 4 and/or the conveying device 7.

The aforementoned additional conveying step enables a certain conveying speed of conveying device 7 to be maintained even if the speed of slide 4 is changed after completion of the cutting stroke. This ensures particularly careful transfer of the cut slices to the depositing position. Such an additional conveying step is conveniently derivable from motor 15 of conveying device 7 which is provided in any case.

The additional conveying step may also be of such length that the total conveying distance of conveying device 7 is larger than the distance covered by slide 4 or also larger than the width of deposit area 9 illustrated in FIG. 2. Provided the conveying device 7 is of appropriate length-wise dimensions, depositing procedures can then also be carried out in more remote areas, for example, conveyor belts or the like spaced at a larger distance can be supplied with cut slices. In particular, the slices can also be knocked off the rotating conveying device by the knocking-off mechanism 20 during the additional conveying step.

Also, in yet another embodiment of the invention, both the position of slide 4 and the position of conveying device 7 may be sensed in order to ascertain by way of comparison and, if necessary, set synchronous motion of the slide and the conveying device. Above all, rotary encoders or the like which can be expediently arranged on the shaft of motor 15 are suitable as sensing means for conveying device 7.

It may also be advantageous to adjust the conveying speed of the conveying device during the additional conveying step in dependence upon the slide speed reached when the additional conveying step is introduced.

What is claimed is:

1. A slicing machine for slicing food such as meat, sausage or cheese, said machine comprising:

a machine frame;

a blade mounted on said machine frame for slicing the food;

first motor means for driving said blade;

a slide slidingly displaceable along a course on said machine frame for accommodating and feeding said food to said blade;

conveyor means, positioned to receive the slices cut by said blade, for carrying said slices to a knocking-off area;

knocking-off means for transferring the slices from said conveyor means at said knocking-off to a deposit area;

second motor means for driving said conveyor means;

means for sensing the positions of said slide as said slide moves along said course; and control means, coupled to receive from the sensing means position data corresponding to the positions of said slide as said slide moves along said course and coupled to said second motor means, for controlling said second motor means to move said conveyor means in synchronism with said slide irrespective of a size of said food.

2. A slicing machine as set forth in claim 1 wherein sad second motor means provides a brake for said conveyor means.

3. A slicing machine as set forth in either claims 1 or 2 wherein said sensing means comprises a rotary encoder coupled to said slide for sensing the positions of said slide.

4. A slicing machine as set forth in either claims 1 or 2 wherein said control means also controls said second motor means to asynchronously drive said conveyor means based on a stroke of said slide.

5. A slicing machine as set forth in claim 1 wherein said control means controls said second motor means to automatically perform an additional conveying step from a certain conveying position onward.

6. A slicing machine as set forth in claim 5 further comprising means for presetting said certain conveying position.

7. A slicing machine as set forth in either claims 5 or 6 further comprising means for presetting a length of a conveying distance covered in said additional conveying step.

8. A slicing machine as set forth in either claims 5 or 6 wherein a total conveying distance of said conveyor means including said additional conveying step is greater than a length of said course covered by said slide.

9. A slicing machine as set forth in either claims 5 or 6 wherein said control means controls a speed of said conveyor means during said additional conveying step based on a speed of said slide at said certain conveying position.

10. A slicing machine as set forth in either claims 5 or 6 wherein said knocking-off means transfers a cut slice of said food from said conveyor means to said deposit area during said additional conveying step.

11. A slicing machine as set forth in either claims 1 or 5 wherein:

said sensing means senses the position of said slide before and during engagement of said food by said blade; and said control means controls said second motor based in part on the positions of said slide before said blade engages said food.

12. A slicing machine as set forth in claim 1 wherein said control means controls said second motor means and thereby said conveyor means to carry a multiplicity of consecutive slices to approximately the same location in said knocking-off area for transfer to said deposit area.

13. A slicing machine as set forth in claim 12 further comprising a support surface defining said deposit area and wherein said control means directs movement of said support surface laterally of said conveyor means after each slice is transferred to said support surface.

* * * * *